United States Patent [19]

Brown et al.

[11] Patent Number: 4,949,816

[45] Date of Patent: Aug. 21, 1990

[54] UPRIGHT FOR LIFT TRUCK

[75] Inventors: Warner K. Brown, Lexington, Ky.; Maynard L. Adams, Bellevue, Mich.

[73] Assignee: Clark Equipment Company, South Bend, Ind.

[21] Appl. No.: 266,534

[22] Filed: Nov. 3, 1988

[51] Int. Cl.[5] ..... B66B 9/20

[52] U.S. Cl. ..... 187/9 E; 414/631

[58] Field of Search ..... 187/9 E, 9 R, 95; 414/630, 631, 663, 785; 52/118, 111, 117

[56] References Cited

U.S. PATENT DOCUMENTS

| | | | |
|---|---|---|---|
| 3,269,561 | 8/1966 | De Ligt | 187/9 E |
| 3,362,503 | 1/1968 | Stoilov | 187/9 E |
| 4,030,568 | 6/1977 | Heinold | 187/9 E |
| 4,069,932 | 1/1978 | Stedman | 214/730 |
| 4,207,967 | 6/1980 | Stedman | 187/9 E |
| 4,355,703 | 10/1982 | Bartow | 187/9 E |
| 4,356,893 | 11/1982 | Johannson | 187/9 E |
| 4,374,550 | 2/1983 | Bartow | 187/9 E |
| 4,401,191 | 8/1983 | Bartow | 187/9 E |
| 4,421,208 | 12/1983 | Robinson, Jr. | 187/9 E |
| 4,432,438 | 2/1984 | Robinson, Jr. | 187/9 E |
| 4,441,585 | 4/1984 | Macnab | 187/95 |
| 4,552,250 | 11/1985 | Luebrecht | 187/9 E |
| 4,585,093 | 4/1986 | Barda, Jr. | 187/9 E |
| 4,657,471 | 4/1987 | Shinoda et al. | 414/663 |
| 4,657,471 | 4/1987 | Shinoda | 414/663 |

*Primary Examiner*—H. Grant Skaggs
*Assistant Examiner*—Kenneth Noland

[57] ABSTRACT

A lift truck upright having a fixed upright section, one or more telescopic upright sections supported outwardly and rearwardly of the fixed section and a load carrier mounted from the outer telescopic section. The side upright rail assemblies are mounted at predetermined forwardly diverging angles relative to the central plane of the lift truck and may be mounted from the truck either over the drive wheels, in front of and in alignment with the drive wheels, or inwardly of the drive wheels, in both two-stage and triple-stage upright constructions. Primary lift cylinders are nested behind respective upright rail sections and, in the triple-stage version, full free-lift cylinders are mounted either in front of the upright rail assemblies or behind said rail assemblies in nested relation with said rail assemblies.

20 Claims, 15 Drawing Sheets

UPRIGHT FOR LIFT TRUCK

BACKGROUND OF THE INVENTION

In lift trucks of the type contemplated it has been one of the most persistent problems encountered over the years to provide an upright construction which affords the operator of the truck good visibility through the upright. Heretofore various means have been devised for improving, or which may incidentally improve, operator visibility through the telescopic uprights of lift trucks, including upright structures such as are disclosed in U.S. Pat. Nos. 4,030,568, 4,069,932, 4,207,967, 4,356,893, 4,401,191, 4,421,208, 4,432,438, 4,441,585, 4,585,093 and 4,657,471. Other exemplary prior art of general background relevance relative to improving such visibility is disclosed in U.S. Pat. Nos. 4,355,703 and 4,374,550 (common assignee) and in patents and cross-referenced applications (now patents) identified and referenced therein.

Such improvements have included locating the lift cylinders outboard, behind, or in front of the uprights, or locating them interiorly of the upright rails. The latter interior construction is illustrated by U.S. Pat. No. 4,441,585, whereas lift cylinders located outboard of the sides of the upright are illustrated by U.S. Pat. No. 4,030,568. U.S. Pat. Nos. 4,355,703, 4,374,550 and 4,421,208 (all common assignee) disclose a plurality of inventions and embodiments which have in common asymmetric upright constructions in which the lift cylinder or cylinders is (are) located behind and asymmetric to the central plane of the upright. U.S. Pat. No. 4,585,093 (common assignee) discloses yet another lift cylinder arrangement with improved visibility, as do the multi-stage uprights disclosed in U.S. Pat. Nos. 4,401,191 and 4,432,438 (common assignee). All of these latter patents have in common a plurality of novel constructions which remove the visibility obstruction inherent in locating lift cylinders in the center of the mast.

U.S. Pat. No. 4,441,585, on the other hand, locates lift cylinders interiorly of the fixed telescopic rails of the upright sections on opposite sides of the upright, and further, locates the outer webs of fixed upright rails at an angle relative to the webs of adjacent movable upright sections.

U.S. Pat. Nos. 4,069,932 and 4,207,967 locate the upright assembly rearwardly of and forwardly of the forward drive wheels, respectively, and at a transverse spacing between the side rail assemblies which are substantially in line with the front drive wheels, thereby increasing the opening between the side rails and the visibility therethrough.

Other patents of general background relevance are cited in certain of the above-identified patents.

SUMMARY OF THE INVENTION

Our invention is a major step forward in the art over any prior known telescopic upright structure for lift trucks in which operator visibility through the upright and relative simplicity and low cost are of importance. In particular our invention provides an extremely novel upright structure which improves and maximizes operator visibility therethrough over any known prior art by providing in combination a "notched" or bracketed upright assembly which locates the side upright rail assemblies over the respective drive wheels spaced at substantially the width of the truck and being mounted from the frame or drive axle of the truck whereby to maximize the space between the side rail assemblies while providing a pair of lift cylinders preferably nested behind the respective upright rail sections in combination with a mounting of the fork carriage assembly from outer channel sections of outwardly and rearwardly mounted telescopic rail sections relative to inwardly mounted non-telescopic rail sections, while arranging the side rail section assemblies at predetermined forwardly diverging angles relative to the central plane of the truck, all of which features combine to maximize operator visibility while providing a number of other advantageous structural results.

Certain of the above primary features are novel per se, such as the angled side rail assembly structure mounted in diverging relation, and the outwardly mounted fork carriage and outwardly and rearwardly mounted telescopic rail sections as aforesaid. Also, a plurality of novel embodiments including two-stage and triple-stage upright assemblies, different lifting systems and rail assemblies, and others, are all within the scope of this invention as will become apparent in the detailed description which follows.

It is a primary object of our invention to provide improved and novel upright structures for use on lift trucks in which vastly improved operator visibility is provided through the upright.

Another important object is to provide an improved upright structure in which overall upright stability and rigidity is enhanced, fork carriage binding is minimized, lost load center is not compromised and free-lift may be provided.

Other objects, features and advantages of the invention will readily occur to persons skilled in the art from the detailed description of the invention which follows.

DETAILED DESCRIPTION

Figure 4:
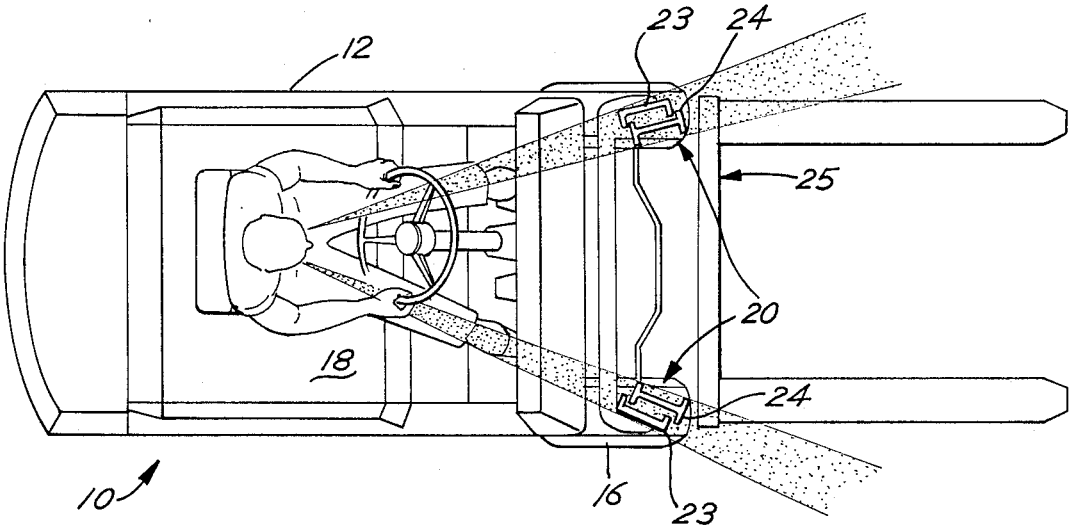
FIG. 4 is a schematized plan view of a lift truck utilizing a second embodiment of a two-stage upright which illustrates an operator's transverse area of visibility through the upright.
Figure 5:
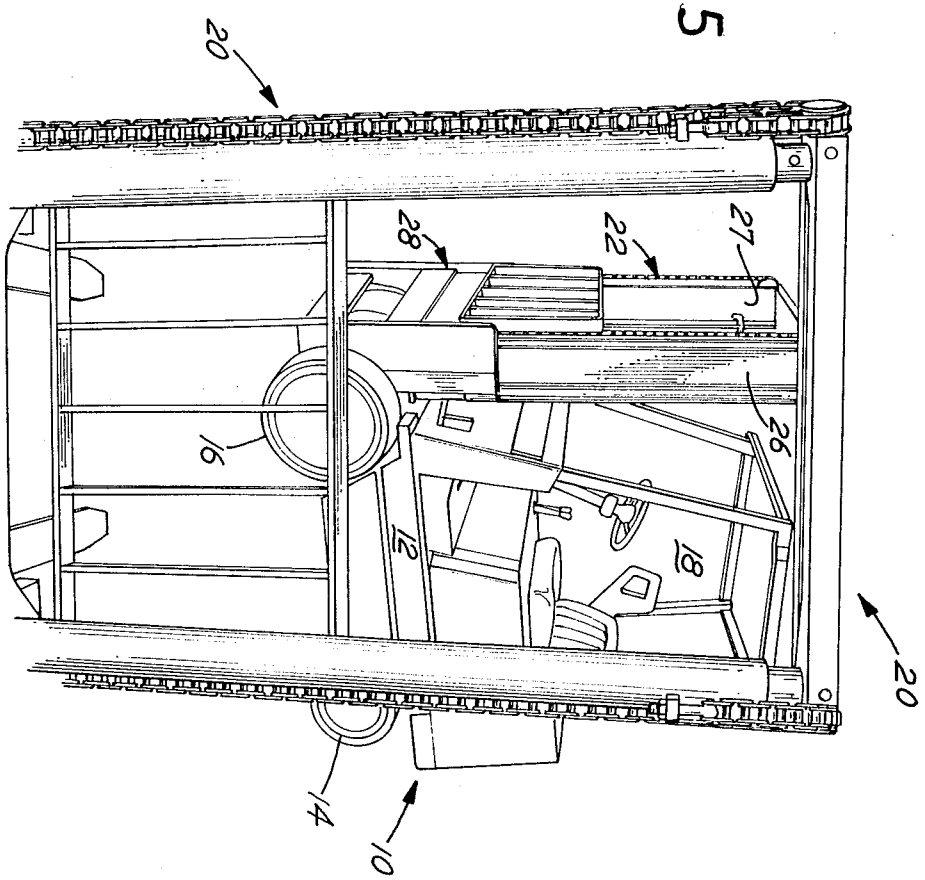
FIG. 5 is a composite view of a two-stage upright showing visibility through the upright of FIG. 4 from an operator's normal location on the seat of the lift truck and wherein for comparative purposes another lift truck is positioned nearby in front of the upright as it would be seen by the operator.

Referring to the drawing, first to FIGS. 4 and 5, a conventional industrial lift truck is shown at numeral 10 having an upright assembly of a type contemplated by this invention. A frame and body construction 12 is mounted on a pair of steer wheels 14 and a pair of traction wheels 16 and embodies suitable power components which may be either electric or gas for operating the truck from an operator's compartment 18. The upright assembly as shown is of the two-stage variety as illustrated generally at numerals 20 and 22, the assembly being mounted on the truck in a manner to be described.

The schematized plan view in FIG. 4 illustrates the approximate transverse range of visibility through the upright of FIG. 5 of an operator seated in a normal position on the lift truck as well as showing the angles of interference with visibility through an upright embodiment which includes divergent angled upright rail assemblies mounted over the drive wheels 16 in a manner to be described. The lift truck as seen through upright 20 of FIG. 5 embodies an upright 22 which may be of a construction similar to that of upright 20, but which is mounted in the usual location between the drive wheels 16. As shown in FIG. 4 the novel divergent angled pairs of rails 23,24 of upright 20 are nested with telescopic I-beams 24 inwardly and forwardly of fixed channel rails 23 and a fork carriage 25 mounted inwardly of the I-beams as is known. Upright 22, on the other hand, represents a novel nesting arrangement wherein I-beam rails 26 are nested outwardly of channel rails 27 and a fork carriage 28 is mounted outwardly of and supported by I-beam rails 26, all as will be described in detail.

Referring now particularly to FIGS. 1–3, 6 and 7 wherein a preferred embodiment of a two-stage upright 30 is illustrated, the upright assembly is adapted to be mounted, as shown, from the front drive axle of a lift truck 10 by a pair of transversely spaced trunnion mounting brackets 32 adapted to encircle bearing surfaces on the axle housing in well-known manner, the upper portions only of the mounting brackets 32 being illustrated. A pair of telescopic rail assemblies 34 are mounted in upright 30 with a fork carriage assembly roller-mounted for vertical movement thereon in such a manner that the transverse outer dimension of the fork carriage is located over the drive wheels 16 along with rail assemblies 34 whereby to effect maximum upright width within the envelope of the lift truck. Mounting brackets 32 are located substantially transversely inwardly of the rail assemblies so that they extend between wheels 16 for engagement with the drive axle, or alternatively, the brackets 32 and connections may be modified so that the upright 30 is supported from shaft pins suitably located forwardly on the frame of the truck, as is known.

Each rail assembly comprises an inner fixed channel or C-section rail 38 secured, as by welding, at the lower inner web surfaces by a transverse plate 40 having secured thereto a downwardly extending transverse plate member 42 which is secured to the lower rear edge portions of rails 38 and to which in turn is secured, as by welding, the trunnion bracket members 32 to the upper edges of which is secured a horizontal platform member 44. Upright 30 is adapted, as is usual, to be tiltable forwardly and rearwardly of a vertical position on the axle by a pair of hydraulic tilt cylinders 46 which are shown as being pivotally connected to the frame 45 of the lift truck at 48 and to the upright at 50 on plate 42. A rigid plate member 47 interconnects the upper ends of said channel beams. Each rail assembly 34 includes a telescopic I-beam section 52 which is nested within each rail section 38 such that the rear flanges of the I-beams are disposed outside of and overlapping the rear flanges of channels 38, and the forward flanges of the I-beams are disposed inside the adjacent forward channel portions and rearwardly of the forward flanges of channels 38, pairs of guide rollers being suitably mounted between said adjacent pairs of the I-beams and channels for supporting the I-beam telescopic section longitudinally and laterally for extensible vertical movement relative to the fixed channel sections. The upper and lower support and guide rollers of each said pair of rollers are illustrated at numerals 54 and 55, respectively; they are rotatably secured adjacent the upper end of the web of each channel rail 38 and adjacent the lower end of the web of each I-beam 52 in vertically spaced relationship for supporting and guiding the I-beam rail sections in vertical movement relative to the fixed channel sections, as is well known.

A fork carriage 56 having fork tines 58 supported from a transverse fork bar 60 spans the entire width of the upright 30 and has contoured side support plates 62 secured to the ends of the fork bars 60, each side plate having mounted thereon upper and lower support and guide rollers 64 which engage the outer channel portions of the respective I-beams 52 such that the fork carriage is movable vertically in relation to the telescopic I-beams. Preferably, and as one of the primary features of our invention, the rail assemblies 34 are each located at a predetermined angle relative to the longitudinal axis of the fork truck so as to provide a forwardly diverging angle between them, as shown and as would be seen by an operator, thus reducing interference with forward visibility as compared with prior standard upright construction in which the rail assemblies have been mounted in parallel with the said axis.

Operator visibility is significantly further improved by the structure as shown, the rail assemblies of which are located over the drive wheels, and is still further significantly improved by another primary feature of our invention, namely, the reverse of standard mounting of the telescopic rail sections 52 outwardly of fixed rail sections 38 and of the fork carriage outwardly of the telescopic sections. In addition, the mounting of the I-beam sections 52 in rearwardly overlapping relationship to the channel sections 38 reduces the load center of the load carried on the fork tines 58 as compared with the prior standard nested I-beam construction of forwardly overlapping I-beam sections. The extra-wide upright assembly also effects greater lateral stability of the upright with reduced tendency to side load binding when the fork tines carry an off-center load, as well as providing improved upright rigidity, all as will be understood by persons skilled in the art.

Figure 3:
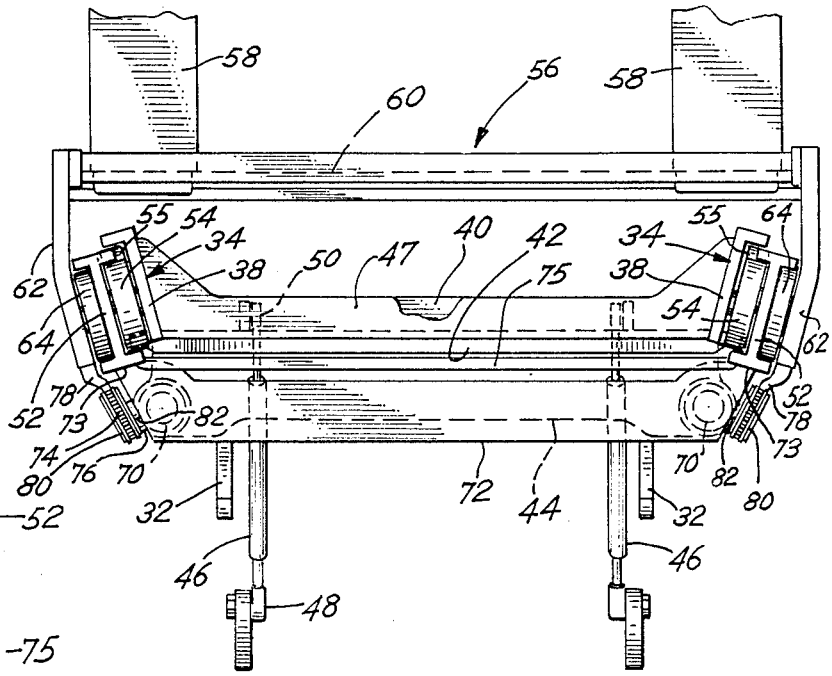
FIG. 3 is a plan view of the upright shown in FIG. 1.

With the fork carriage mounted in the forwardly angled rail assemblies as shown, side plates 62 are contoured as shown in FIG. 3 so that the guide rollers 64 properly engage the outer channel sections of the I-beams, and the lower rearward edges of each plate 62 is contoured at 66 so that with the upright mounted over the drive wheels the side plates 62 do not interfere with or contact the tires when the fork carriage is in a lowered position.

As mentioned previously, FIG. 4 illustrates schematically a standard nested I-beam rail assembly insofar as inner I-beams 24 overlap outer fixed channel sections 23 in a forward direction, which construction is not as desirable as that illustrated in FIG. 3 in respect of upright stability, rigidity and maximum operator visibility. The FIG. 4 embodiment does provide, however, very good visibility within the context of a more standard rail assembly in that it utilizes the diverging angle-mounted rail assemblies in an extra-wide upright assembly mounted over the drive wheels, all as is shown by the relatively small angles of interference with operator visibility.

Particulars of nested offset I-beam upright structure, the mounting of the load carriage thereon and details of structure and mounting of guide and support roller pairs are described in detail in assignee's exemplary U.S. Pat. No. 3,213,967, as well as in, to a limited extent, U.S. Pat. No. 4,374,550. Although the I-beam nesting arrangement above described with respect to FIGS. 1–3, 6 and 7 is the reverse of the nesting arrangement shown in said prior patents in that the telescopic I-beams are mounted outside of and nested in rearwardly overlapping relationship to the fixed channel sections, the nesting principle is similar in respect of the manner in which the guide and support rollers are mounted therein. However, it should be understood that the nested I-beam rail assemblies as described above are for illustrative purposes only and that any suitable rail assembly structure, such as multiple roller mounted channels or C-sections, or any variety of special rail sections, are well within the scope of this invention which includes, for example, the concepts of forwardly diverging angle mounted rail assemblies, the mounting thereof over drive wheels in an extrawide assembly, and the reverse and outside nesting of telescopic rails and fork carriage. It should also be understood that the forwardly diverging rail assemblies, within the scope of this invention, can be readily mounted in a more standard relationship to the lift truck either from the truck frame or drive axle laterally transversely inside of the drive wheels, such as shown at upright 22 in FIG. 5, and in any rail assembly configuration in the use of diverging angle-mounted rail assemblies. Furthermore, the upright assembly with any of the above-noted variations can be readily mounted from the drive axle forwardly of and in line with the drive wheels if maximum upright width is desired to further enhance operator visibility. It will be understood that if the upright is mounted over the drive wheels, as are uprights 20 and 30, that for a given collapsed height of the upright a certain amount of maximum fork height will be sacrificed but without increasing the load center of any load carried on the fork carriage, while an upright assembly mounted ahead of the drive wheels will entail a certain loss of load center without a sacrifice in maximum fork height, all as will be understood by persons skilled in the art.

A pair of transversely spaced lift cylinder assemblies 70 are supported from platform 44 at opposite sides of the upright in a location behind the respective rail assemblies so as to not interfere with operator visibility through the upright and are connected at the upper piston rod ends to an upper transverse plate member 72 which is secured to the rear flanges of I-beam rails 52 at 73, as shown in FIG. 3. A transverse plate member 75 is secured at opposite ends to the lower end portions of I-beam rails 52 as shown in FIG. 3. A pair of lift chains 74 are connected at their one ends to chain anchors 76 located on the respective lift cylinders and at their opposite ends to chain anchors 78 located at the rear edges of side plates 62, said chains being reeved on respective lift sprockets 80 which are mounted for rotation on shafts 82 which are secured to opposite ends of plate member 72.

Figure 1:
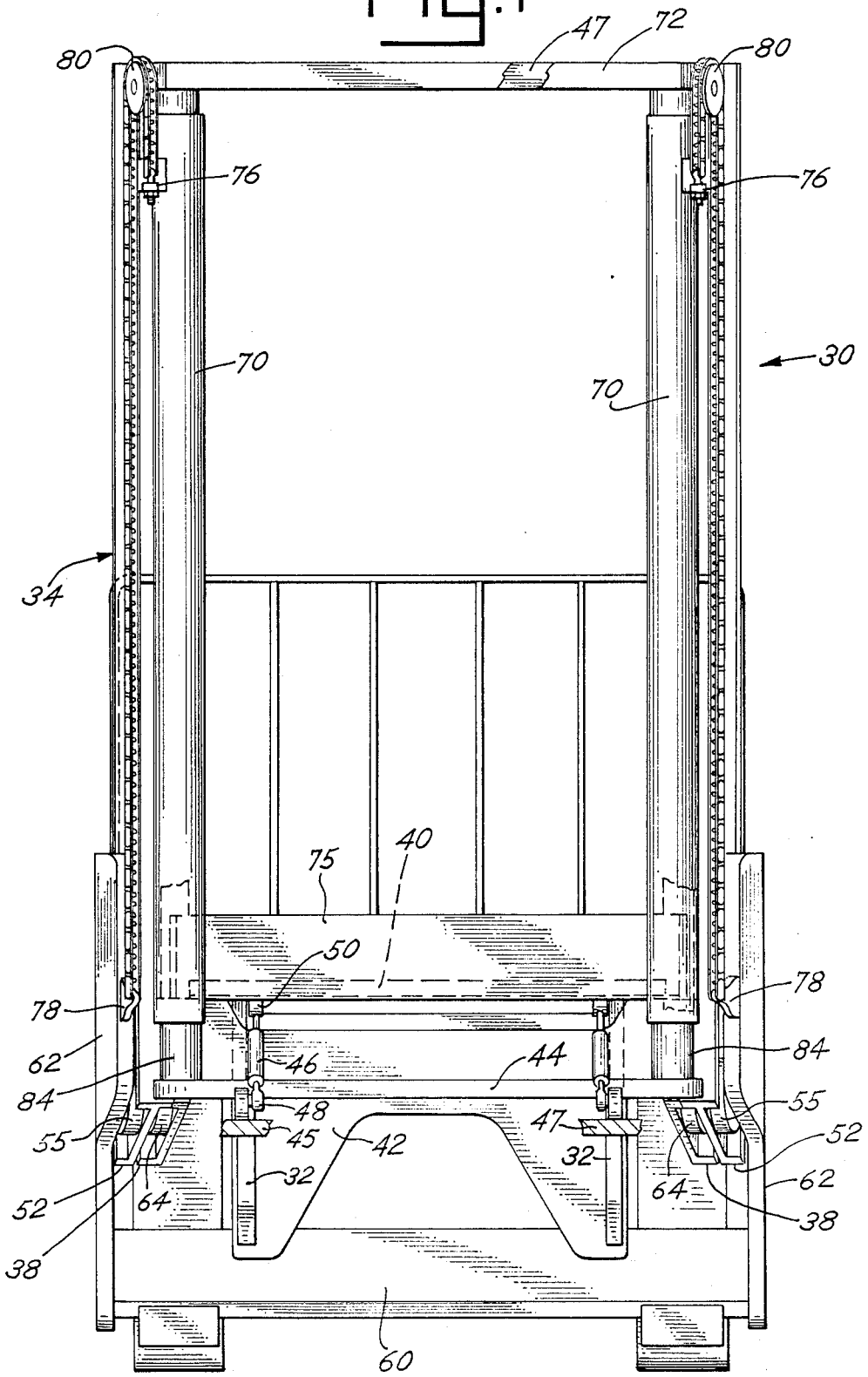
FIG. 1 is a rear elevational view of a retracted two-stage telescopic upright in which the load carriage is located at the bottom of the upright.
Figure 2:
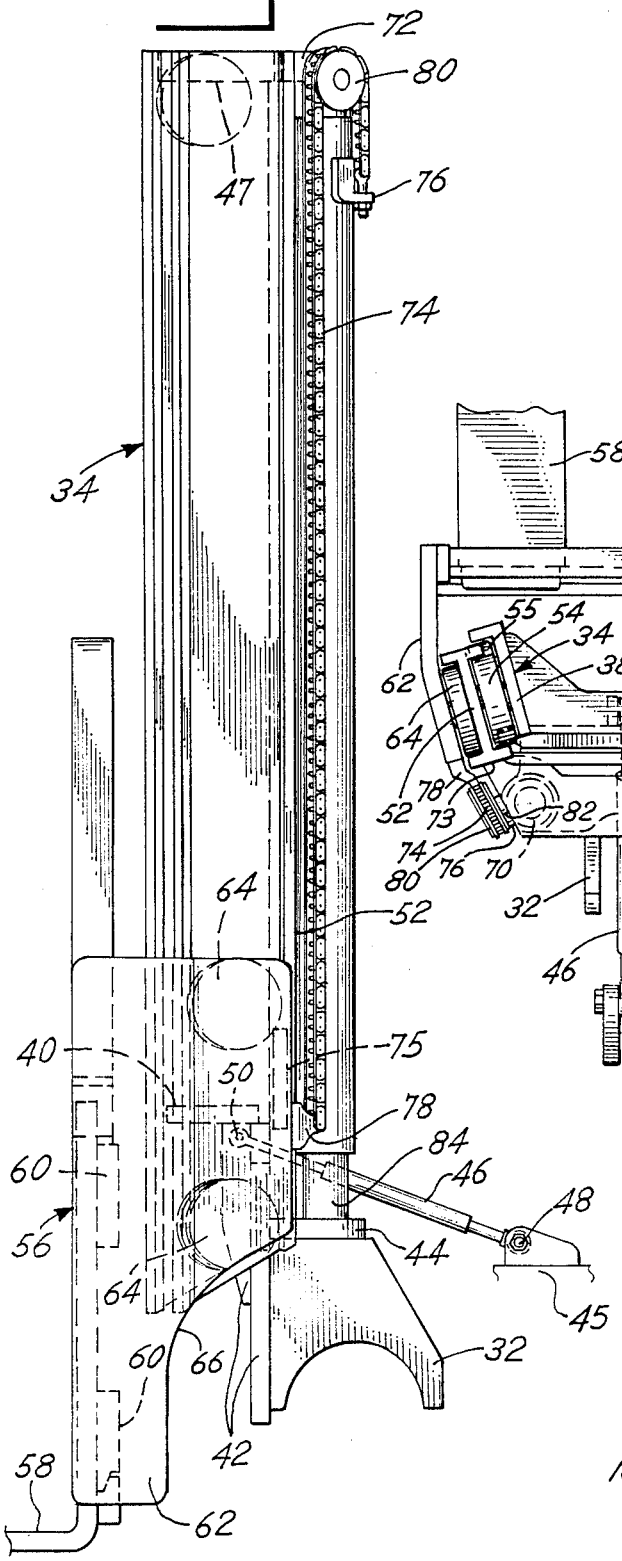
FIG. 2 is a side elevational view of the upright shown in FIG. 1.
Figure 3A:
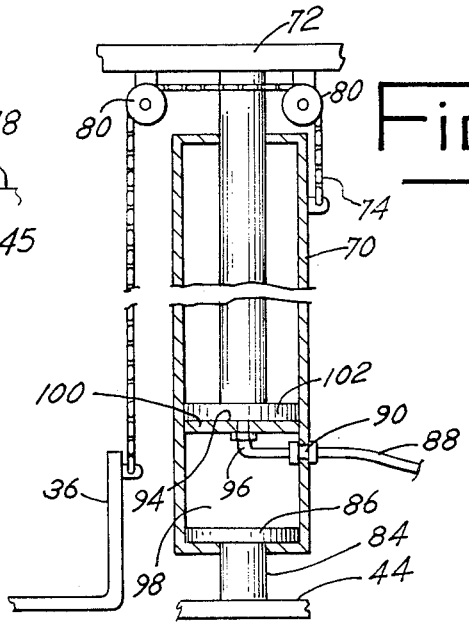
FIG. 3A is a schematized longitudinal sectional view of a lift cylinder as shown in FIGS. 1 and 9.
Figure 6:
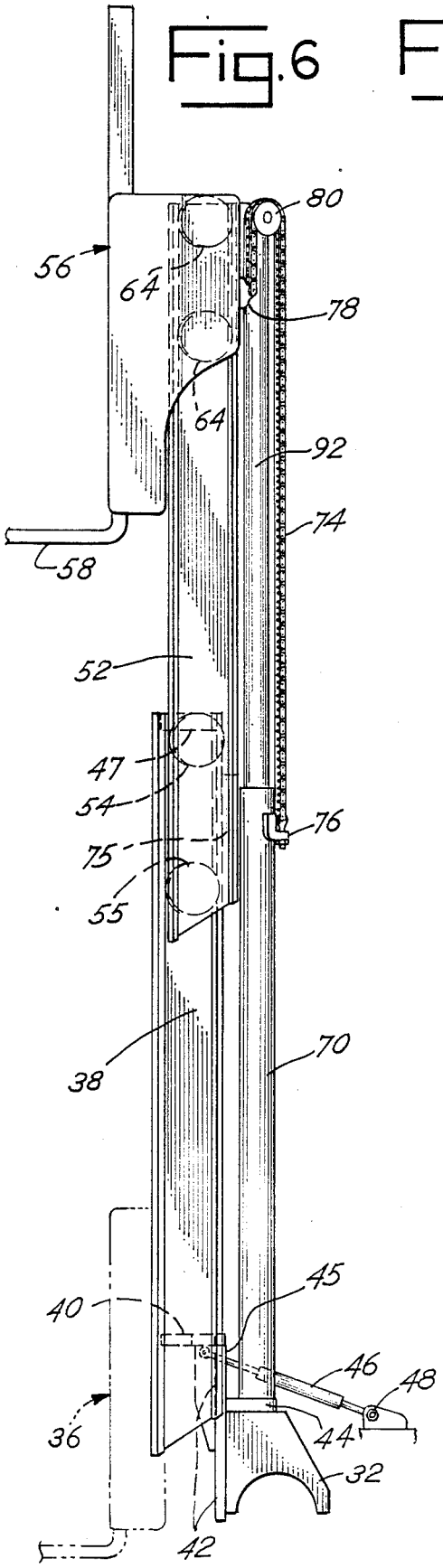
FIGS. 6 and 7 illustrate the two-stage upright of FIGS. 1–3 in side and rear elevational views, respectively, and wherein the fork carriage is located at maximum elevation.
Figure 7:
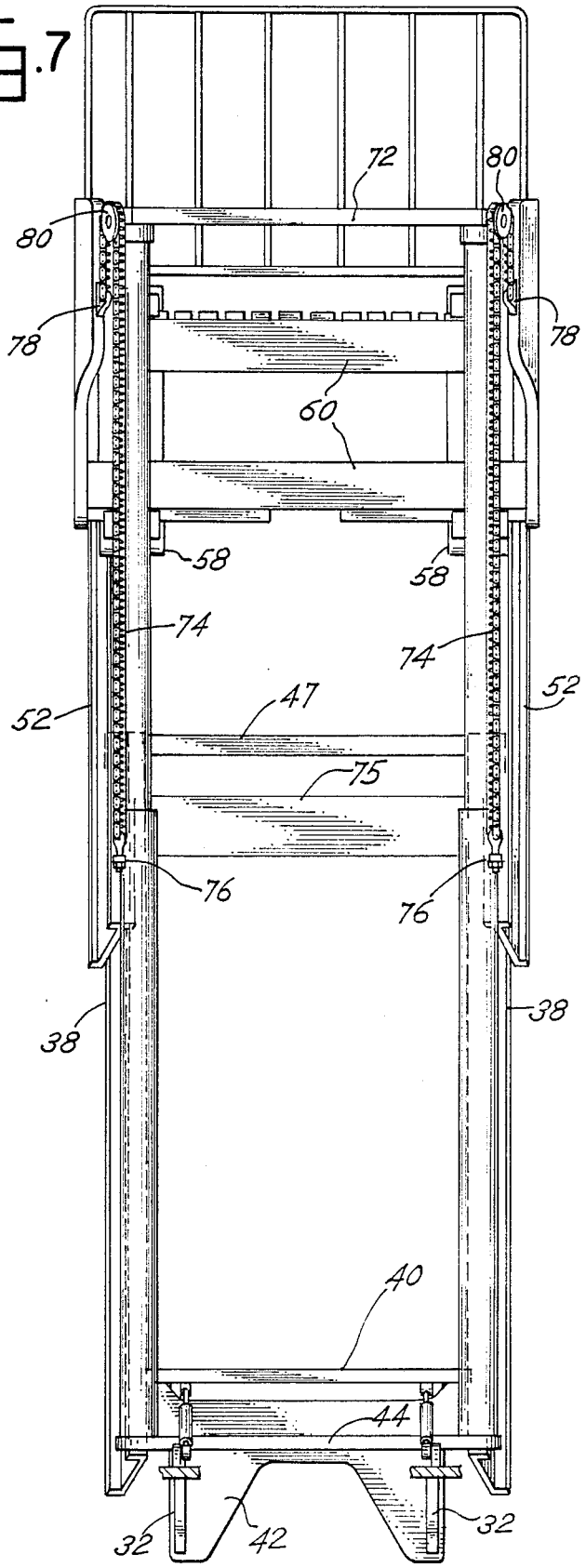

Referring now to FIG. 3A, means has been devised for providing a degree of free lift in this upright. A lower cylinder support rod 84 is secured to platform 44 and has formed at its upper end a fluted head 86 on which slides the cylinder barrel. As shown in FIG. 1, it will be noted that each cylinder barrel is elevated on support rod 84 whereas in FIGS. 6 and 7 the cylinder barrels are in fully down positions in abutment with support plate 44. Movement of each cylinder barrel downwardly on rod section 84 from the FIG. 1 position elevates the fork carriage at a 1:1 movement ratio until each cylinder barrel bottoms on plate 44. This is accomplished as shown in FIG. 3A which illustrates in schematic cross-section the lift cylinder assembly 70 and chain 74 connected to carriage 36. An oil pressure line 88 is connected to the cylinder barrel at 90 which selectively communicates pressure fluid from a hydraulic system, not shown, to an oil chamber 94 via internal conduit 96 which extends through an air chamber 98 and a cylinder wall 100 for operating the cylinder barrel and lift pistons 102 therein. When the cylinder barrel abuts the underside of the fluted head of member 84 and piston 102 is fully retracted in abutment with wall 100, as shown, fork carriage 36 is in a fully lowered position. When pressure fluid is introduced through conduits 88 and 96 into chamber 94 it is applied effectively first to wall 100 to actuate downwardly the cylinder barrel on rod 84 into abutment with platform 44 which actuates chain 74 with the cylinder barrel to elevate fork carriage 36 to its free-lift position which is a distance substantially equal to the length of rod 84, following which pressure fluid is applied in chamber 94 to piston 102 to elevate fork carriage 36 via the chains and sprockets 74 and 80 to a selected elevation in the upright which terminates at a maximum fork height position as shown in FIGS. 6 and 7, at which time piston head 102 may abut the upper end of the cylinder barrel. The upright is lowered from said position by releasing the fluid pressure in the system whereby piston head 102 forces fluid out of the cylinder to sump until it is fully retracted with telescopic rail assembly 34, and with fork carriage 36 then located at its free lift position, the weight of the fork carriage with or without any load thereon continues to function to actuate the cylinder barrel upwardly into abutment with head 86 and piston 102, at which time fork carriage 36 is again at floor level as in FIG. 3A.

Figure 8:
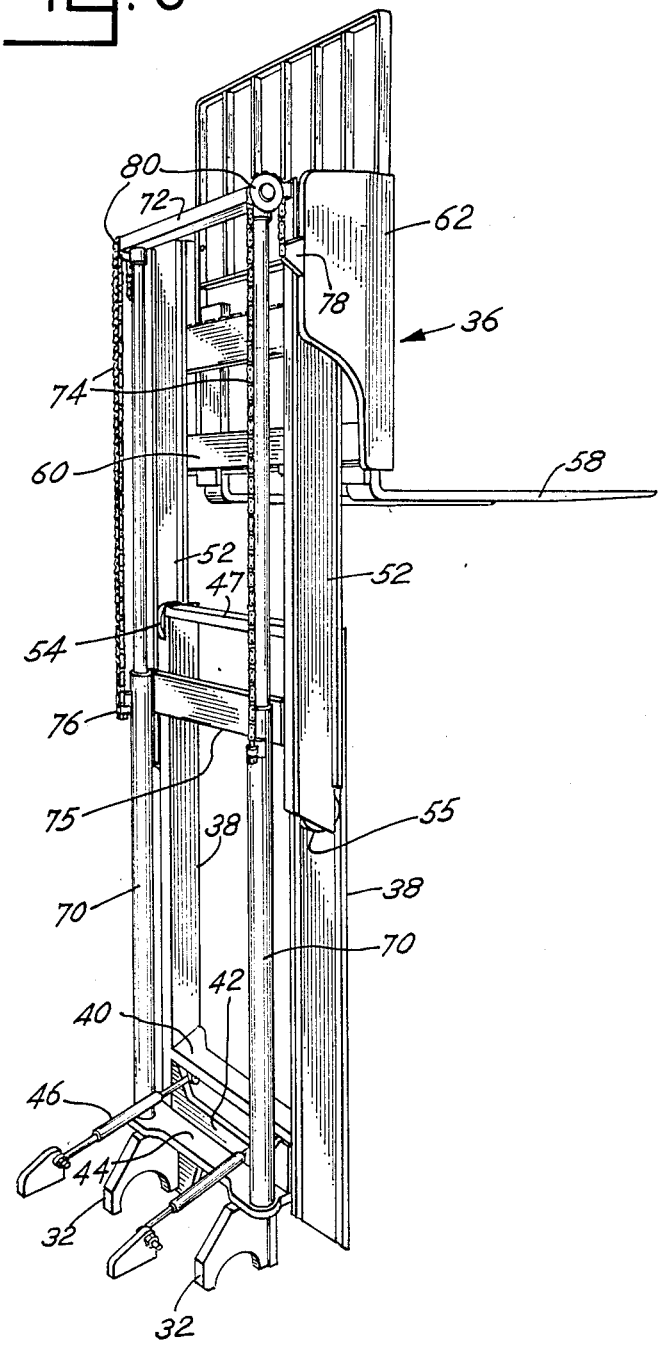
FIG. 8 is a perspective view of the upright as shown in FIGS. 6 AND 7.
Figure 9:
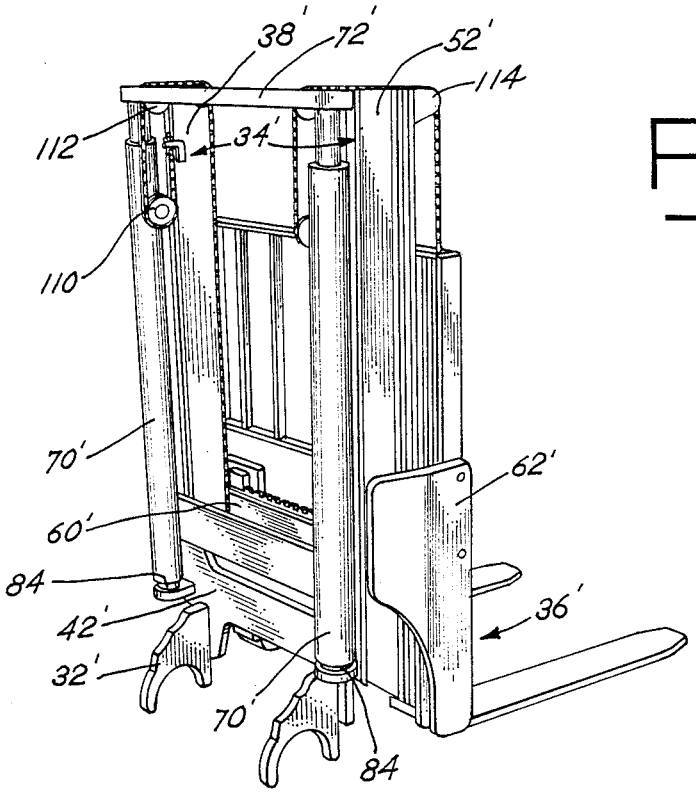
FIG. 9 is a perspective view of another embodiment of a two-stage upright in free-lift position.
Figure 10:
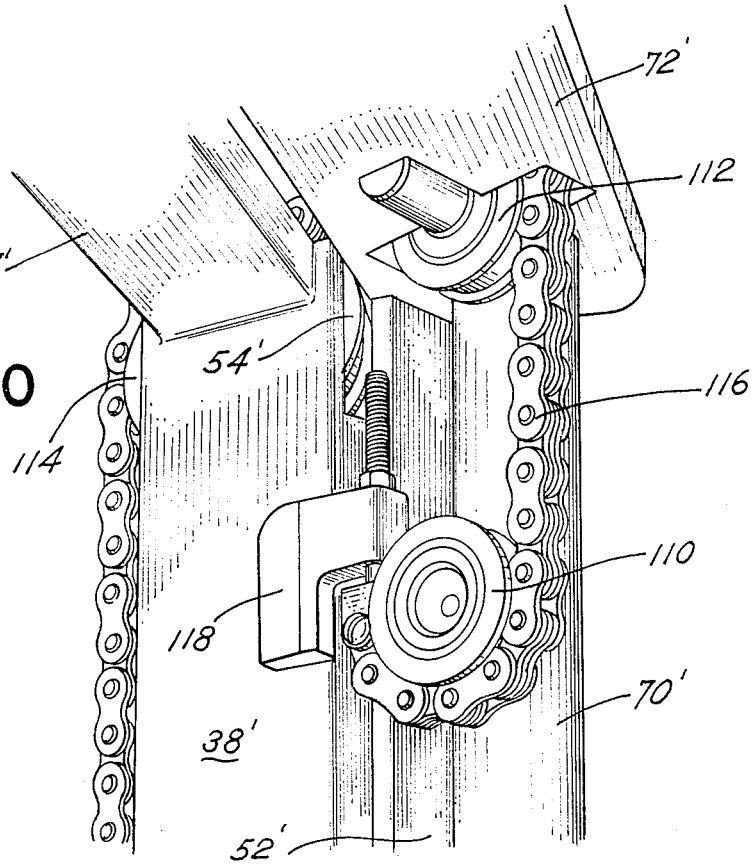
FIG. 10 is a perspective view showing a detailed portion of the chain reeving of FIG. 9 when the upright is in a fully lowered position.
Figure 11:
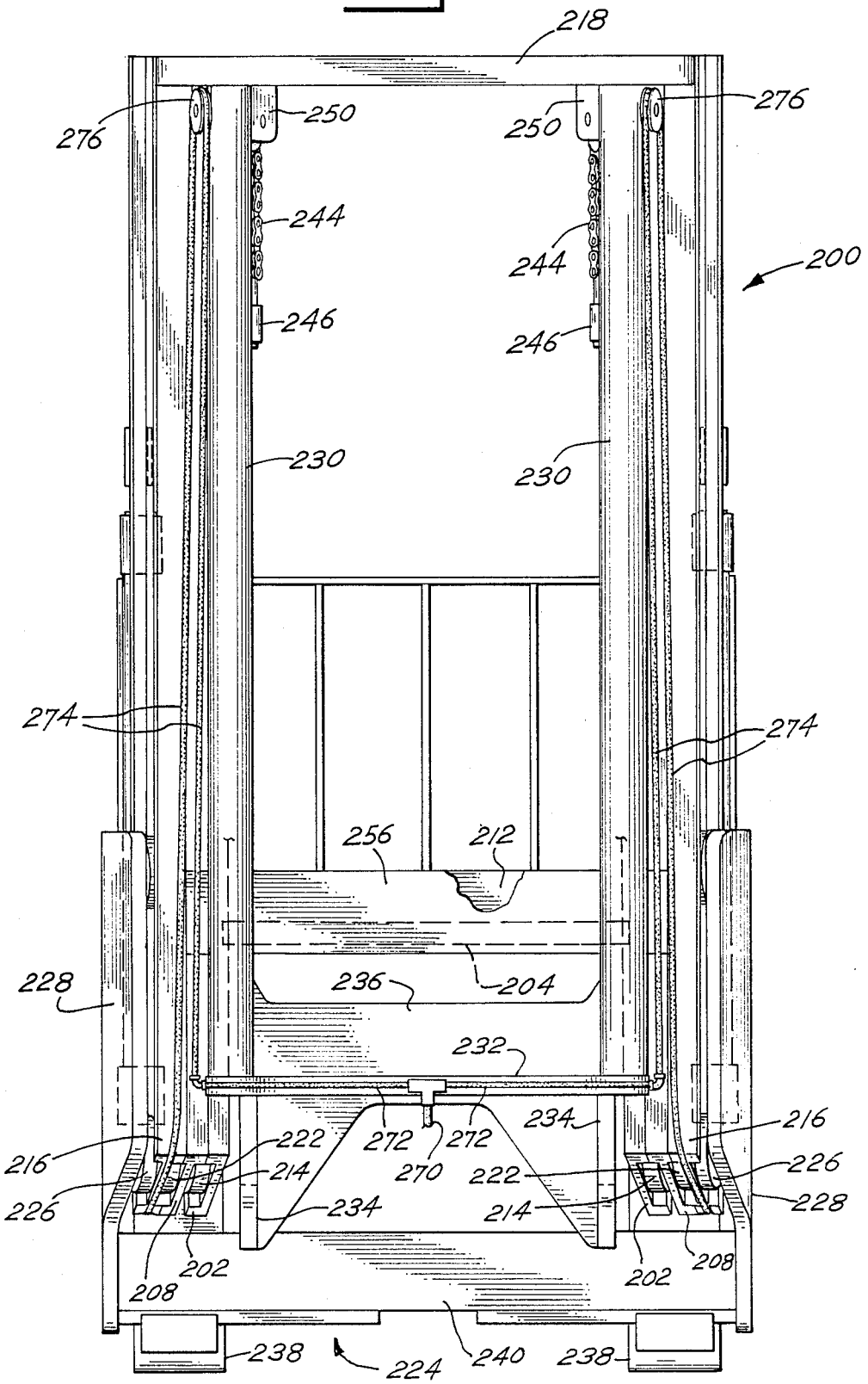
FIG. 11 is a rear elevational view of one embodiment of a triple-stage upright in which the load carriage is located at the bottom of the upright.
Figure 12:
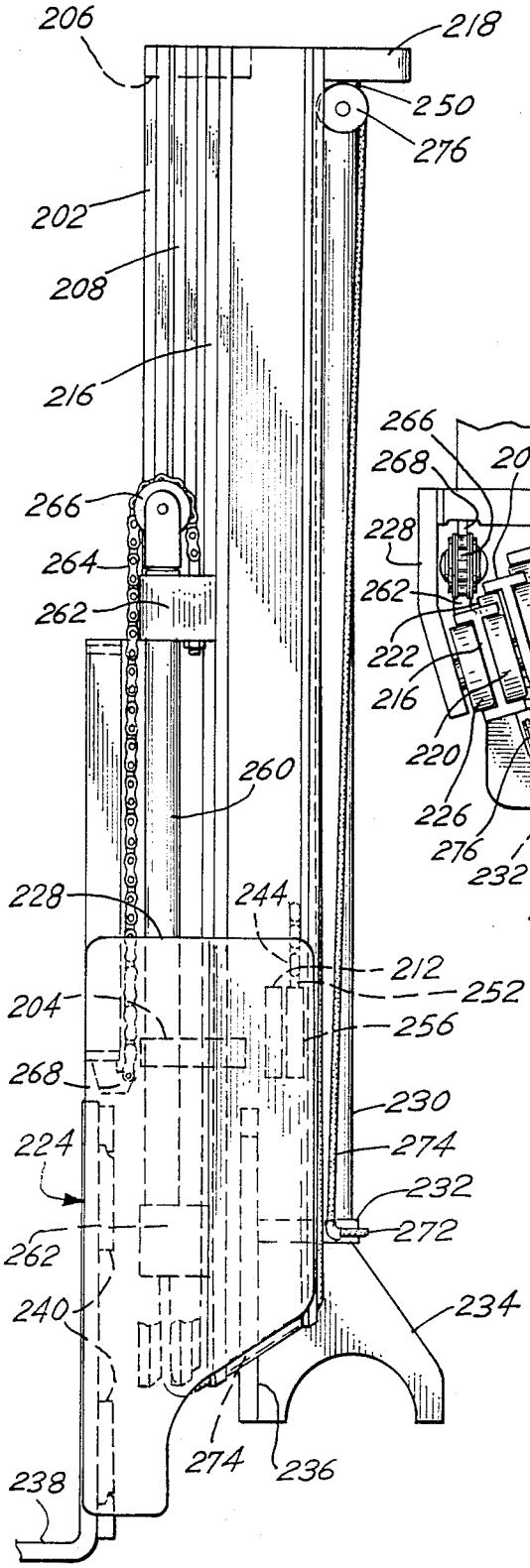
FIG. 12 is a left side elevational view of the upright shown in FIG. 11.
Figure 13:
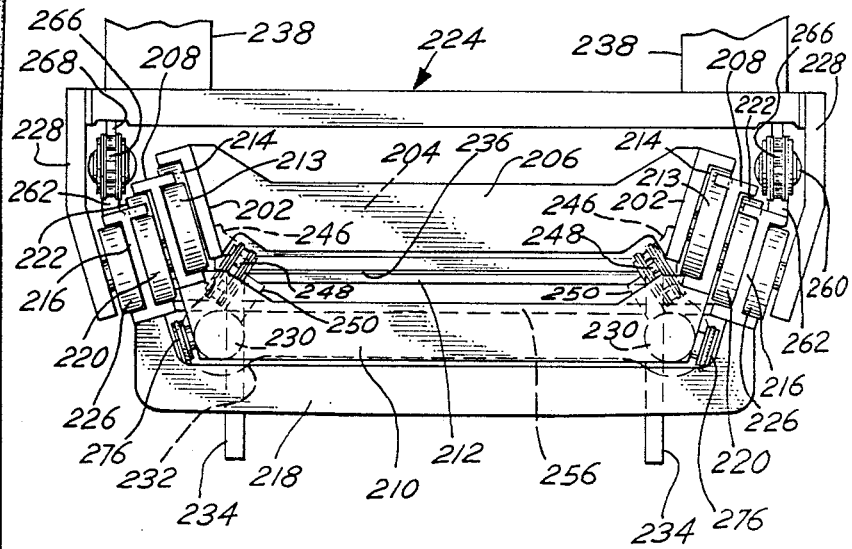
FIG. 13 is a plan view of the upright shown in FIG. 11.
Figure 14:
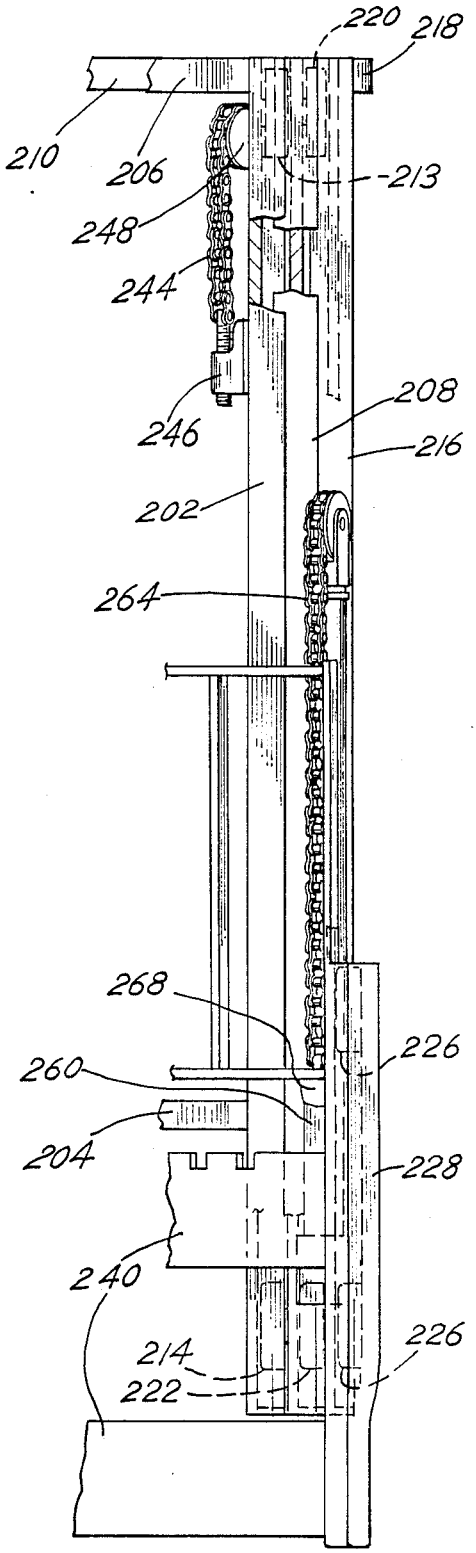
FIG. 14 is a partial front elevational view of the upright shown in FIG. 11.

Referring now to FIGS. 9 and 10, there is shown a modified chain reeving structure. Otherwise the embodiment is similar to that of FIGS. 6–8, and similar parts have been similarly numbered with a prime. Within that basic upright structure the chain reeving system comprises three chain sprockets 110, 112 and 114 on each side of the upright with each sprocket 110 suitably mounted from a cylinder 70', sprocket 112 suitably mounted in each end of tie bar and brace member 72' and each sprocket 114 suitably mounted at the upper end of respective channels 38' A portion of the one upper guide roller is shown at 54' in FIG. 10. A chain 116 is connected at each side of the upright to a chain anchor member 118 which is mounted on the web of a channel 38' and is then reeved under sprocket 110 and over sprockets 112 and 114, being threaded over the top ends of each side rail assembly 34', and thence threaded downwardly to transversely spaced anchor members on load carriage 36', not shown, similar to the anchors 78 in FIGS. 6–8, but said anchors being located inwardly of the sides of the load carriage on one of the fork bars 60'.

The operation of embodiment of FIGS. 9 and 10 is similar to that of FIGS. 1–3 and FIGS. 6–8, including the free-lift operation of FIG. 3A, the lift cylinders 70' actuating directly the outer I-beam rail sections 52' through tie-bar and brace member 72', and load carriage 36' at a 2:1 movement ratio via the chain and sprocket system such that the load carriage is operated in free-lift as in FIG. 3A, and reaches maximum fork height as shown in FIGS. 6–8.

Referring now to FIGS. 11–17, similar principles of upright construction are applied as in FIGS. 1–10 to a high visibility full free lift triple stage upright.

One embodiment of such an upright assembly is shown generally at numeral 200. The upright comprises a pair of transversely spaced fixed upright channel rails 202 secured near the lower ends thereof by a transverse plate member 204 and at the upper ends thereof by a transverse plate member 206 in such a manner that they provide a forwardly diverging angle of visibility through the upright. A pair of intermediate I-beam rails 208 are connected by upper and lower transverse plate members 210 and 212, the intermediate I-beam rail section being supported for telescopic movement in the channel section by an upper pair of support and guide rollers 213 mounted from respective ones of the webs of the channels 202 and by lower rollers 214 mounted adjacent the lower ends of the upright from the webs of I-beams 208 so that the I-beams are in rearwardly overlapping relationship in respect of the flanges of the respective I-beams and channels. Likewise, a pair of outer nested and rearwardly overlapping I-beam rails 216 connected together adjacent the top thereof by a transverse plate member 218 are supported for telescopic movement in I-beams 208 by upper and lower pairs of guide rollers 220 and 222, respectively, the upper rollers 220 being mounted from the webs of I-beam 208 and rollers 222 from the webs of I-beams 216. A fork carriage 224 spans the upright and, as in the embodiment of FIGS. 1–7, is supported from the outer channels of I-beams 216 by upper and lower pairs of rollers 226 which are mounted from the contoured ends of rearwardly extending fork carriage side plates 228.

A pair of primary transversely spaced lift cylinders 230 are supported at the lower ends from a platform 232 which is in turn supported from a pair of transversely spaced axle trunnion bracket mounts 234, the upper portions of which are shown in the drawing, and which are in turn secured to a transverse brace plate 236 which connects together the channels 202 at the lower ends thereof. A pair of fork tines 238 are mounted in the usual manner from a pair of fork bars 240 which extend between and are secured to side plates 228 for mounting the fork carriage in the upright as shown.

Lift cylinders 230 extend to the top of the upright in a retracted condition and are connected at the piston rod ends thereof to transverse brace member 210 which interconnects the upper ends of intermediate I-beam rails 208. A pair of lift chains 244 are each secured at one end to a chain anchor 246 which is secured to each inwardly facing web surface of channel beams 202 as shown, from which the chains are reeved on a pair of transversely spaced sprockets 248 supported for rotation in a pair of sprocket mounting brackets 250 which are secured to and depend downwardly from brace member 210, the chains thence extending downwardly to connect with a pair of anchor members 252 secured to a transverse plate member 256 which interconnects the lower end portions of I-beams 216.

A pair of transversely spaced free lift cylinders 260 are supported from the forward flanges of respective ones of I-beams 216 each by a pair of vertically spaced bracket members 262 located at the upper and lower ends of each said cylinder. A lifting chain 264 is anchored at its one end on each upper bracket 262 and is then reeved over a sprocket 266 mounted on a crosshead of the piston rod of each cylinder 260, each chain being anchored at its opposite end to fork carriage 224 at 268. Cylinders 260 are one-half the height of the retracted upright assembly so that when pressure fluid is applied to these singleacting cylinders the pistons elevate the fork carriage at a 2:1 movement ratio to maximum elevation in the retracted upright, known as "full free lift", and maintains the fork carriage in that position during subsequent elevation of the outer and intermediate telescopic sections by main lift cylinders 230. It will be noted from the drawing that cylinder assemblies 260 are also nested in the upright assembly adjacent the front thereof so that there is no additional interference with operator visibility resulting from the location of the cylinders. They are nested within "pockets" provided by the particular nesting of the outer and intermediate I-beam rails, as will be observed.

Flexible hydraulic conduit means 270, 272 and 274 provide pressure fluid to pairs of lift cylinders 230 and 260. Conduit 270 is connected to a hydraulic system, not shown, and upon operator demand, directs pressure fluid through conduit 272 to conduits 274 which extend upwardly and are reeved on sheaves 276 supported from the upper ends of the lift cylinders 230 and then downwardly behind the rear flanges of the I-beams 216 through grooves formed in the bottom ends of the I-beams and thence upwardly to connect with the bottoms of free-lift cylinders 260.

Figure 15:
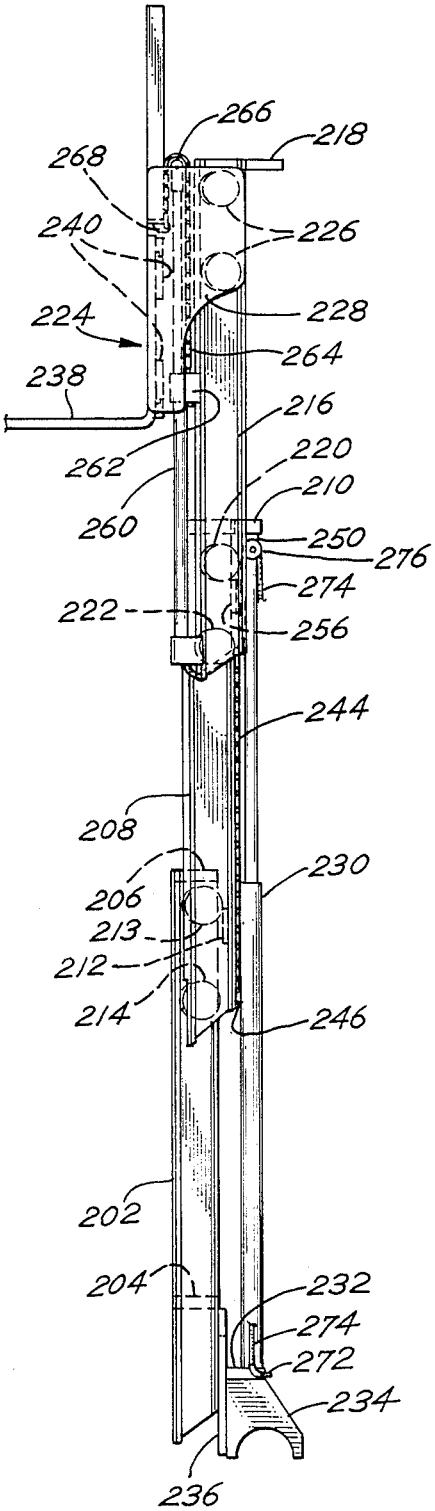
FIGS. 15 and 16 are left-side and rear elevational views, respectively, of the upright shown in FIG. 11 wherein the load carriage is shown at maximum elevation.
Figure 16:
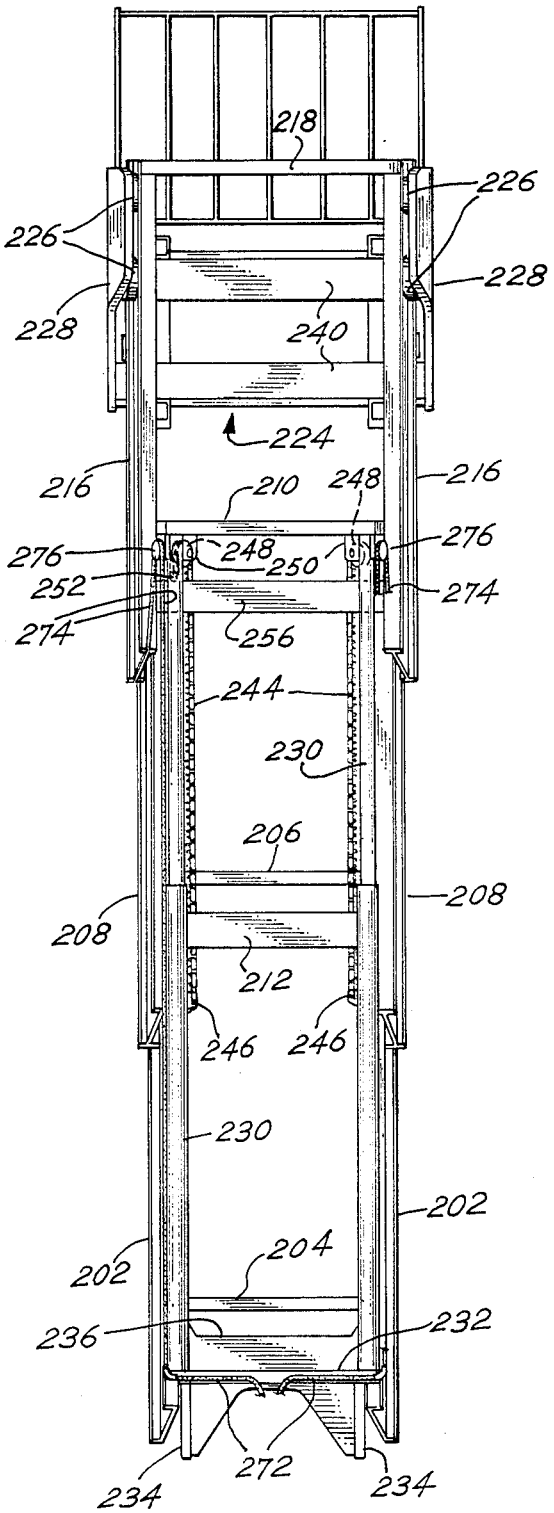
Figure 17:
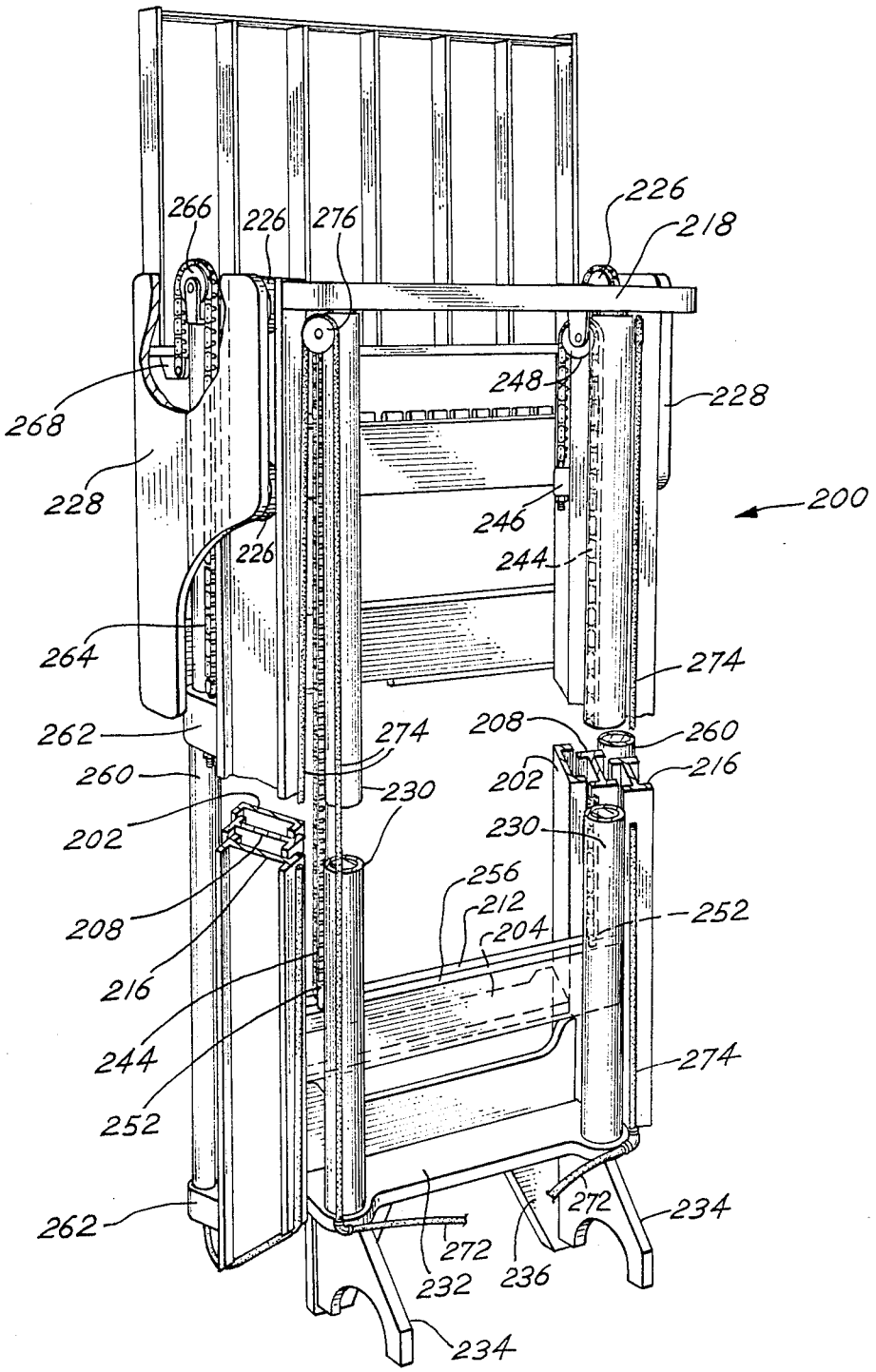
FIG. 17 is a rear-quarter perspective view of the upright shown in FIG. 11 with the load carriage in a full free-lift position and showing a partial sectional cutaway for clarification.
Figure 20:
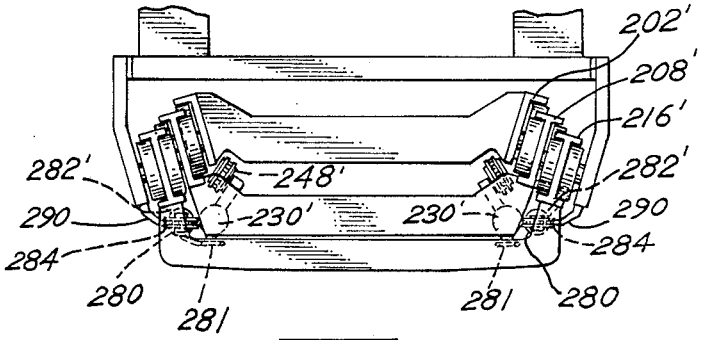
FIGS. 18, 19 and 20 are rear elevation, side elevation and plan views, respectively, of a modified triple-stage upright structure in which the load carriage is located at the bottom of the upright.
Figure 19:
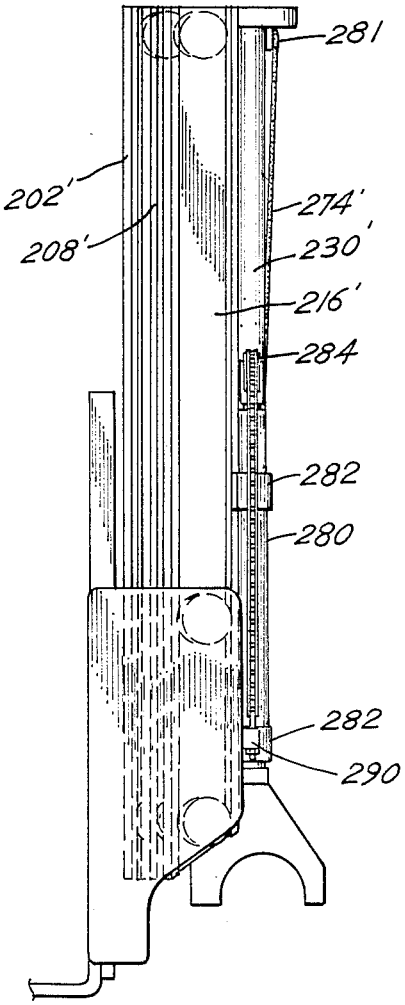
Figure 18:
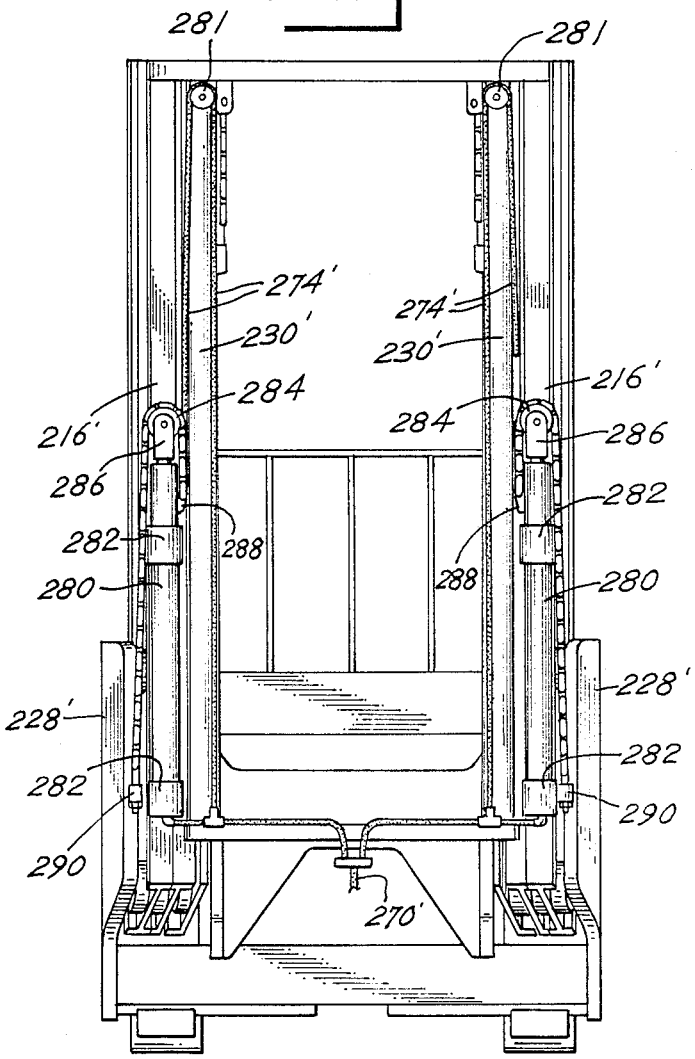
Figure 22:
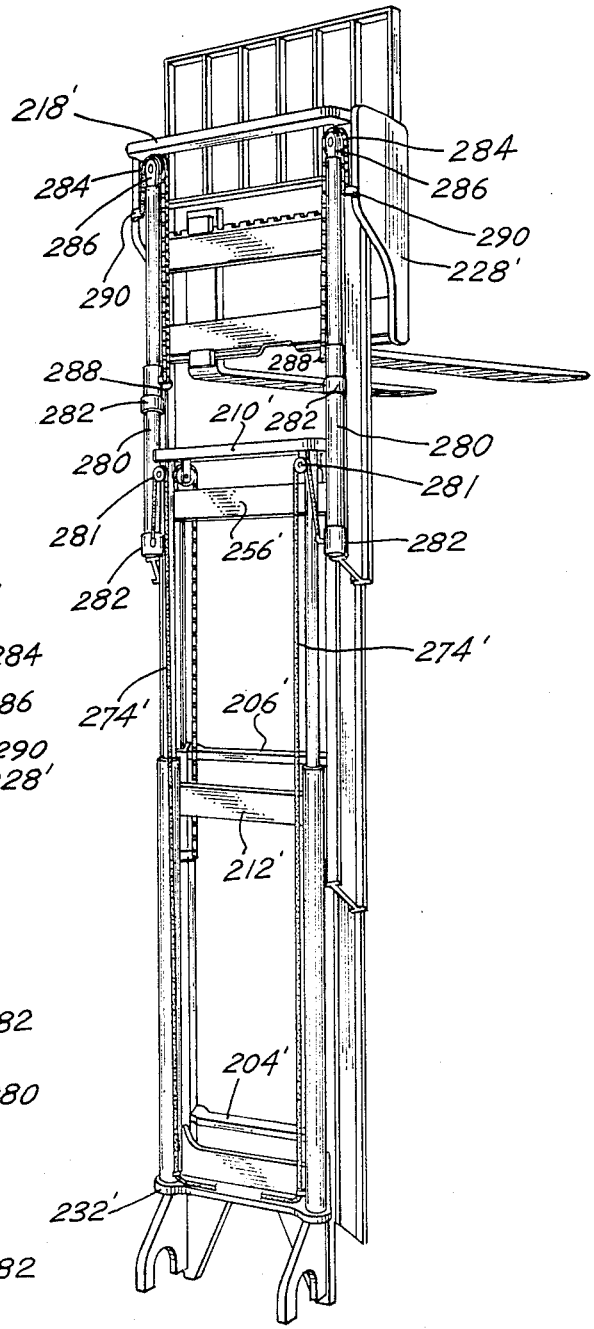
FIG. 22 is a rear quarter perspective view of the upright shown in FIG. 18 with the load carriage at maximum elevation.
Figure 21:
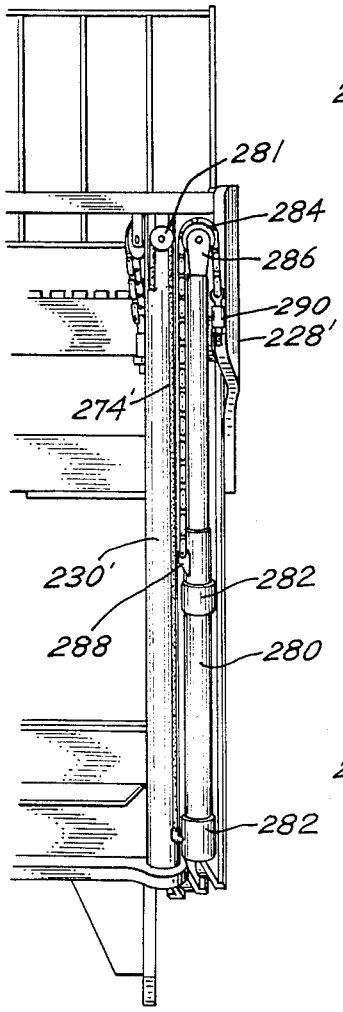
FIG. 21 is a partial rear elevational view of the upright as shown in FIG. 18 with the load carriage in full free-lift position.

In operation, the application of pressure fluid to the conduits operates first on the free-lift cylinders 260 to elevate the fork carriage in the collapsed upright as above described, and then operates in sequence main lift cylinders 230 to elevate the intermediate and outer I-beam uprights in simultaneous telescoping upward movement in relation to fixed upright rails 202 to a selected elevation which terminates at a maximum fork height position as shown in FIGS. 15 and 16, as is well known in respect of the sequencing and elevation of triple stage uprights with full free lift. In respect of all embodiments of our invention it is understood, of course, that the design and arrangement of all transverse plate or brace members which extend between upper and lower end portions of each pair of corresponding rails are such that they by-pass each other as required during elevation and lowering of the upright, as is well known.

Referring now to FIGS. 18–22, a preferred embodiment of a triple-stage upright is illustrated wherein the structure is similar to that shown in FIGS. 8–13 except that a pair of free lift cylinders 280 are located at the rear of the upright rather than at the front thereof as are cylinders 260, in which location it will be noted such cylinders are also hidden behind the upright rail sections, i.e., they do not interfere with operator visibility. Otherwise, the upright as illustrated may be the same as in the previous embodiment; only a few of the parts have been numbered, common parts having the same numerals primed as appear in FIGS. 8–13. The hydraulic conduit 274' is shown as being reeved at either side of the upright on two right angle sprockets 281, these conduits being joined at supply conduit 270'. It may be found advantageous to reeve the flexible conduit or conduits on one or both of chain sprockets 248' rather than on separate sheaves 281 so as to eliminate the extra cost of hose sheaves and mountings.

Each of cylinders 280 is mounted at its upper and lower ends to the rear flange of respective I-beam rails 216' by a pair of brackets 282. Each chain sprocket 284 is mounted from a crosshead 286 to the piston rod of cylinder 280 and a lift chain is reeved from an anchor member 288 located on each cylinder to an anchor member 290 located on the rear side of each fork carriage side plate 228'. Locating the cylinders 280 at the rear of the upright rather than at the front thereof has the advantage of minimizing the possibility of damage to these cylinders in operation of the lift truck as well as eliminating the need for reeving the flexible conduit 270 under the upright rail to the front mounted locations of the cylinders.

It will be noted that pairs of chain sprockets 248 and 248' in the triple stage embodiments disclosed are mounted at opposed angles to the angular mounting of the side upright assemblies so as to most efficiently use the nesting spaces available in the upright. In FIGS. 11–17 the free-lift cylinders 260 are mounted in the nesting spaces provided ahead of the upright by the rearward nesting of the upright rails, whereas in FIGS. 18–22 the free lift cylinders 280 are mounted substantially transversely of and behind outer I-beams 216', all for the purpose of efficient use of the spaces available and to avoid interference with operator visibility.

The operation of the upright in FIGS. 18–22 is the same as in FIGS. 11–17.

Referring now to the diagrammatic views of FIGS. 23–26, a few exemplary variations of the large number of upright mounting and rail structures available within the scope of our invention are shown in diagrammatic form illustrating various angles of visibility through the upright.

Figure 23:
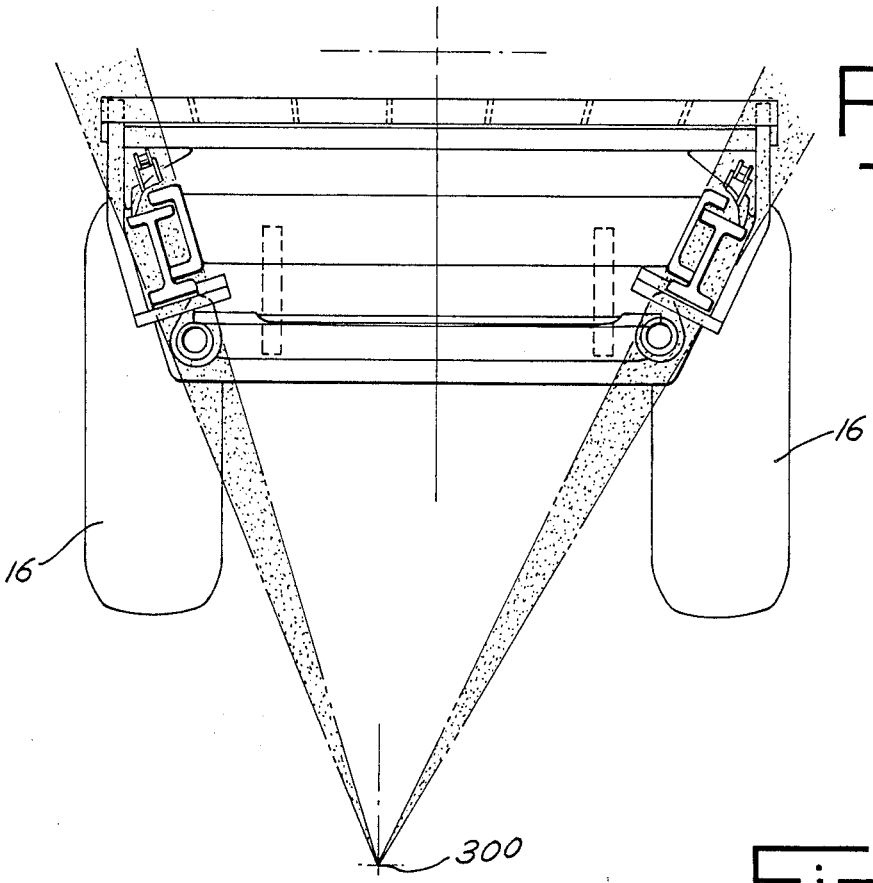
FIGS. 23–26 are diagrammatic plan views showing various exemplary transverse angles of operator visibility through various configurations of the upright.

FIG. 23 represents an asymmetric design of diverging angled two-stage rail assemblies which provide optimal visibility by aligning both upright rails with the operator's eye represented at numeral 300. As the operator is located off-center, we provide that the rails be rotated asymmetrically with respect to the centerline of the truck, as shown, so that the blind angles represented are equal as seen by the operator.

Figure 24:
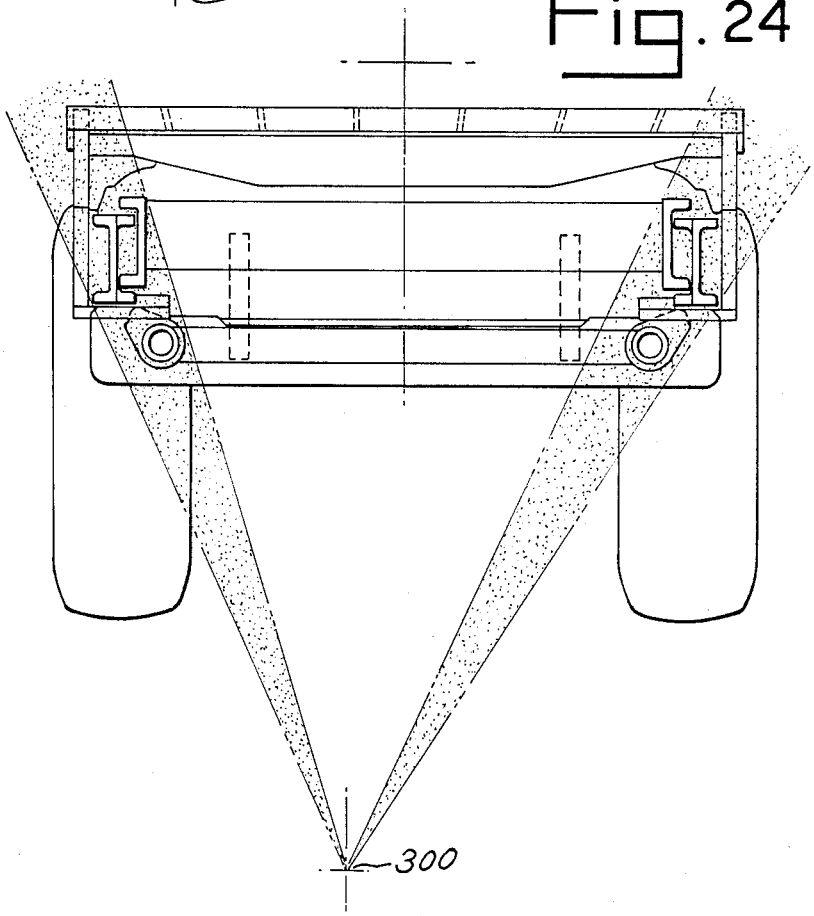

FIG. 24 illustrates a symmetrical design in which two-stage rail assemblies are rotated equally and in parallel. The right upright rail assembly is a mirror image of the left upright rail assembly. As shown, there is an increase in the blind angles represented in FIG. 24 as compared with FIG. 23 as a result of the rail assemblies being mounted in parallel in of FIG. 24 as compared with the mounting of the rail assemblies in FIG. 23 which provide a diverging angle therebetween as viewed from the operator's station. In addition, the symmetrical design of FIG. 24 wherein the right and left rail assemblies are mirror images of each other, results in a slightly greater blind angle on the right side from the operator's eye 300 when the operator is located off-center of the axis of the lift truck as shown. Although the blind angle is somewhat larger on the right side as compared with left side in FIG. 24, there may be some manufacturing advantage in a symmetrical design.

The structure of FIG. 23 may, of course, be also arranged in a symmetrical design as in FIG. 24 except that the rail assemblies are rotated to equal angles in relation to the centerline so that the rail assemblies are mirror images of each other resulting in a somewhat larger blind angle through the right hand rail assembly similar to FIG. 24.

In both FIGS. 23 and 24, as well as in FIG. 26 as will be observed below, it should be noted that the rail assemblies are mounted over and in alignment with the drive wheels 16, all in accordance with previous embodiments of our invention as disclosed.

Figure 26:
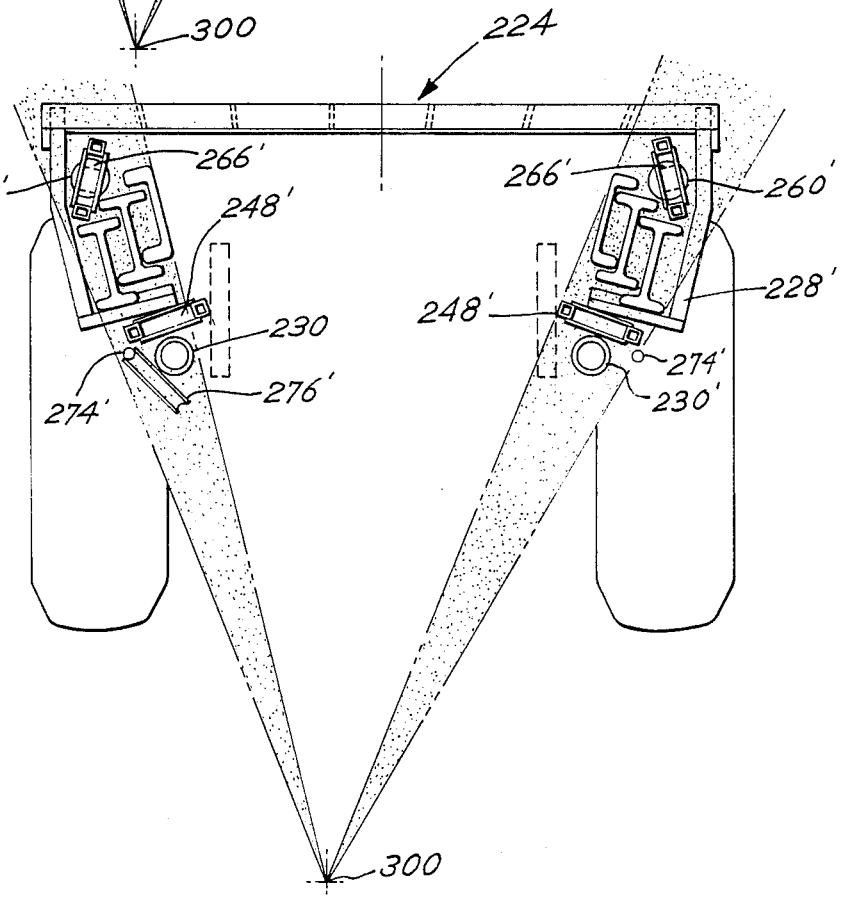

FIG. 26 represents the blind angle from the operator's eye 300 in a triple-stage upright of a construction similar to the embodiment disclosed in FIGS. 11–17. In this arrangement, the rail assemblies are symmetrical in relation to the centerline of the lift truck so that the blind angle through the right rail assembly from the operator's eye is slightly larger than the blind angle through the left rail assembly. The mounting angles of the various chain sprockets and hydraulic hoses is shown somewhat different from the angles shown in FIGS. 11–17, and similar parts have been numbered with the same numeral primed. It will also be noted that the hydraulic hose is reeved on the left side only of the upright over sheave 276', the hose having a direct connection without reeving on the right hand side as the numeral indicates and as will be understood.

Figure 25:
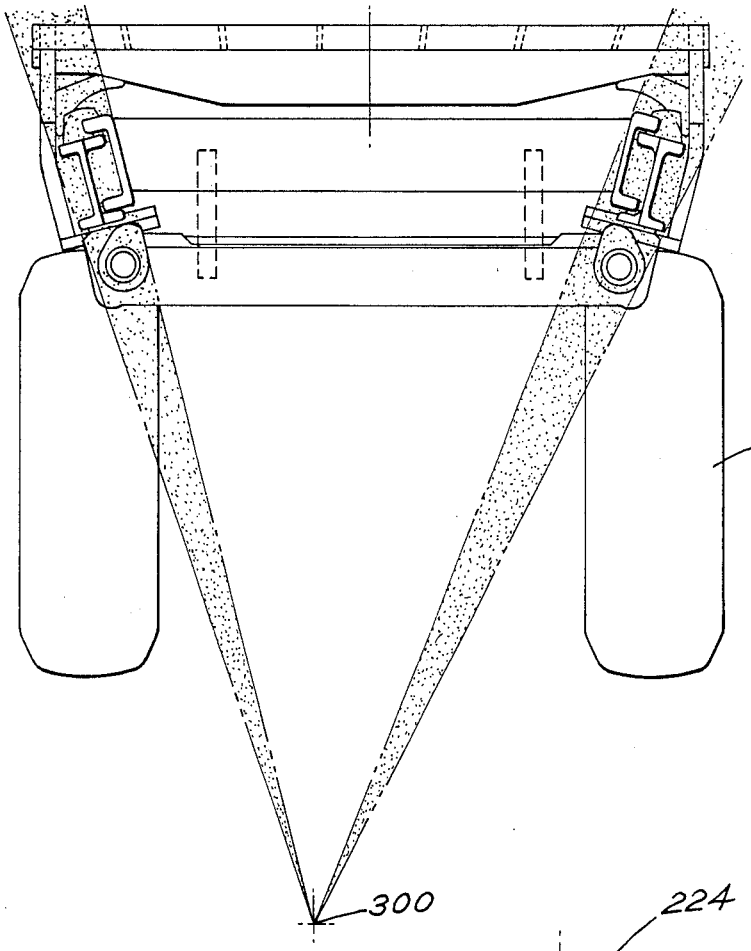

FIG. 25 illustrates a two-stage upright wherein the rail assemblies are located to provide a diverging angle between them similar to that of FIG. 23 but with a symmetrical design similar to that of FIG. 24 so that the right side blind angle is somewhat larger than the left side blind angle. In FIG. 25 the rail assemblies are located in front of the wheels 16 and the upright may be adapted to be supported from the truck frame by shaft pins or be trunnion mounted from the axle.

The embodiments of FIGS. 23, 24 and 26 all have the disadvantage of reducing maximum fork height because the rail sections of the rail assemblies must be shorter for a given down-height of the upright as will be understood. To provide the improved visibility of this invention without reducing the maximum fork height, as in FIG. 25, it becomes necessary to place the upright in front of the wheels. The disadvantage in this approach, however, is that lost load center is increased, as will be understood.

The designer of uprights of various widths, depths, seat locations, and the like may choose any one of a number of viable combinations of such structure within the scope of our invention. As mentioned previously this may involve, for example, any one of a number of upright rail section types including I-beams and/or channel sections nested in any designer selected rail-to-rail relationship, only a preferred nesting relationship being disclosed in certain of the various embodiments herein, with the angle or angles of the rail section assemblies in relation to the longitudinal axis of the lift truck being variable as desired depending upon the location of the operator in normal seated position at a distance rearwardly of the upright and centrally or to one or the other sides of the longitudinal axis of the lift truck, as well as the variable locations of lift cylinders and chains, all to the end that acceptable or maximized operator visibility through the upright be realized. It will, however, be recognized by persons skilled in the art that the novel upright rail section and fork carriage assemblies as disclosed herein provides for greater upright stability and rigidity of the upright than heretofore, as well as maximizing operator forward visibility. It will also be understood that while the embodiments specifically disclosed herein illustrate upright assemblies mounted over or in front of the drive wheels of the lift truck to further enhance visibility therethrough, the scope of our invention includes mounting of the upright assembly in the usual manner from the drive axle or frame inside the width of the drive wheels with upright rail assemblies of any type mounted at a selected angle or angles in relation to the longitudinal axis of the lift truck, as well as with the rail assemblies per se nested as disclosed with the telescopic rail sections mounted transversely outwardly of fixed channel sections and with the fork carriage mounted transversely outwardly of outer telescopic rail sections.

In all embodiments contemplated it is preferred that the lift cylinder or cylinders on each side of the upright be located, along with respective lifting chains, to minimize interference with operator visibility beyond that inherently present by the location of the upright assembly. The manner of reeving lift chains and hydraulic conduits in the upright is a matter of designer selection, although it is preferred that they also be located in such a manner as to minimize interference with operator visibility, such as in the embodiments disclosed.

All of the foregoing, of course, applies in principle to any multiple upright section, whether two, three, four or more stages of elevation are provided in any given upright design. Before the particulars of any given upright design are finalized it should be understood that in any multi-section upright using this invention, whether of two, three or more stages, and regardless of available numerous design variations such as are described herein, it is preferable that the entire upright assembly be located such that it projects a minimum amount into the normal line of sight of the operator through the upright. A normal line of sight may be defined as comprising the operator's line of sight when located in a predetermined design position and attitude for normal operation of a lift truck. Depending upon such things as the axial distance of the operator from the upright, the width of the upright, or the transverse position of the operator when seated or standing in a normal operating position on different lift truck types, the most desirable precise location of the upright assembly to achieve minimum interference with operator visibility based upon various design factors, some of which are discussed above, will be established. The most critical combination of factors effecting such location is operator visibility, which may be compromised from the ideal within the scope of our invention as required to effect the most desirable overall combination of upright structure.

Although we have illustrated only exemplary embodiments of our invention, it will be understood by those skilled in the art that many modifications may be made in the structure, form, and relative arrangement of parts without departing from the spirit and scope of the invention. Accordingly, we intend to cover by the appended claims all such modifications which properly fall within the scope of our invention.

We claim:

1. In an upright assembly for lift trucks and the like, a fixed upright section mounted from the lift truck having fixed rails located at opposite sides thereof, at least one of said rails being mounted at a forwardly directed divergent angle in relation to the longitudinal axis of the lift truck, and a telescopic upright section supported from the fixed upright section for elevation thereon having movable rails located at opposite sides thereof, at least one of said movable rails being supported from said one fixed rail at substantially said forwardly directed divergent angle.

2. An upright assembly as claimed in claim 1 wherein the other of said fixed and movable rails are also mounted at a forwardly directed divergent angle in relation to the longitudinal axis of the lift truck.

3. An upright assembly as claimed in claim 2 wherein one assembly of said fixed and movable rails are mounted at a predetermined first such divergent angle and the other set of said fixed and movable rails are mounted at a predetermined second such divergent angle.

4. An upright assembly as claimed in claim 3 wherein said first and second predetermined angles are established in relation to the location of a lift truck operator in such a manner as to effect maximum operator visibility from the operator's normal line of sight through the upright in relation to the said first and second angles.

5. In an upright assembly for lift trucks and the like having a fixed upright section mounted from the lift truck including fixed rails located at opposite sides thereof, a telescopic upright section supported from the fixed upright section for elevation thereon including movable rails located at opposite sides thereof and a load carriage mounted from said movable rails for elevation thereon, the improvement comprising mounting of said movable rails on said fixed rails being transversely outwardly of said fixed rails and mounting of said load carriage on said movable rails being transversely outwardly of said movable rails, said fixed and movable rail assemblies and said load carriage being mounted from the lift truck in such a manner that they are located substantially in the longitudinal planes of a pair of lift truck drive wheels whereby to increase operator visibility through the upright, and a pair of upright mounting means secured substantially transversely inwardly of said rail assemblies for mounting the upright assembly from the lift truck.

6. An upright assembly as claimed in claim 5 wherein said movable rails are I-beam means mounted in nested relationship with said fixed rails such that the forward flanges of said I-beam means overlap inside of outwardly facing flanges of channel sections of said fixed rails and the rearward flanges of said I-beam means overlap outside of outwardly facing flanges of channel sections of said fixed rails, said nested relationship being in a direction rearwardly of the lift truck, and said load carriage is mounted from the outwardly directed channel sections of said I-beam means.

7. An upright as claimed in claims 5 or 6 wherein said sides of the load carriage are contoured to avoid engagement with said drive wheels when the upright assembly is retracted and the load carriage is fully lowered.

8. An upright as claimed in claims 5 or 6 wherein the fixed and movable rails are located in forwardly diverging vertical planes in relation to an operator's forward vision such that expanded operator visibility through the upright is effected.

9. An upright as claimed in claim 8 wherein opposite sides of said load carriage are contoured rearwardly inwardly to engage the outer channel means of said movable rails.

10. In an upright assembly for lift trucks and the like having a fixed upright section mounted from the lift truck and a telescopic upright section mounted from said fixed upright section for elevation relative thereto by lift cylinder means, the improvement comprising angularly mounted fixed and telescopic upright rails at opposite sides of the upright sections so that they are located in forwardly diverging vertical planes in relation to an operator's forward vision such that expanded operator visibility through the upright is effected.

11. An upright as claimed in claim 10 wherein the movable rails are mounted transversely inwardly of the fixed rails.

12. An upright as claimed in claim 10 wherein the movable rails are mounted transversely outwardly of the fixed rails.

13. An upright as claimed in claim 12 wherein the movable rails are mounted in rearward overlapping relationship with the fixed rails.

14. An upright as claimed in claims 11 or 12 or 13 wherein a lift cylinder means is mounted rearwardly of each side of the upright substantially within the vertical plane of the rail assembly on each side of the upright and which is operatively connected to the respective movable rails for elevating the latter in the fixed rails, whereby the lift cylinders provide substantially no interference with operator visibility through the upright in addition to that resulting from the location of the upright rail assemblies.

15. An upright as claimed in claims 11 or 12 or 13 wherein said fixed and movable rails are mounted from the lift truck in such a manner that they are located substantially in the longitudinal planes of a pair of lift truck drive wheels whereby to increase operator visibility through the upright.

16. An upright as claimed in claim 12 wherein a fork carriage is mounted from outer channel means of said movable rails.

17. An upright as claimed in claim 16 wherein opposite side means of the load carriage are contoured rearwardly inwardly to engage said outer channel means of the movable rails.

18. An upright as claimed in claims 2 or 10 wherein lift cylinder and lift chain means are mounted on each side of the upright behind the respective rail assemblies and substantially within the vertical planes of the rail assemblies and sides of the load carriage taken together, each said lift cylinder and chain means being operatively connected to the telescopic upright section and to the load carriage for elevating the latter in the telescopic section and the telescopic section in the fixed upright section, whereby the lift cylinder and chain means are substantially non-interfering with operator visibility through the upright.

19. An upright as claimed in claims 1 or 10 wherein a load carriage is mounted in the telescopic upright section for elevation relative thereto, and a pair of transversely spaced lift cylinder and chain means are located behind the rail assemblies operatively connected to said rail assemblies and to said load carriage for elevating said load carriage and said telescopic upright section on said fixed upright section, said lift cylinder and chain means providing free lift to said load carriage by means comprising in each lift cylinder fixed and movable piston members, said fixed piston member being to first supplying pressure fluid to the cylinder to actuate the cylinder downwardly on said fixed piston member predetermined distance whereby to actuate the load carriage through said operative connection a predetermined distance in elevation, said pressure fluid being then applied to said movable piston member to elevate said load carriage and telescopic upright section.

20. In an upright assembly for lift trucks and the like having a fixed upright section mounted from the lift truck including fixed rails located at opposite sides thereof and a telescopic upright section supported from the fixed upright section for elevation thereon including movable rails located at opposite sides thereof, the improvement comprising mounting of said movable rails transversely outwardly of said fixed rails, said fixed and movable rails assemblies being mounted from the lift truck in such a manner that they are located substantially in the longitudinal planes of a pair of lift truck drive wheels whereby to increase operator visibility through the upright, and a pair of upright mounting means secured substantially transversely inwardly of said rail assemblies for mounting the upright assembly from the lift truck.

* * * * *